US011965304B2

(12) United States Patent
Liu et al.

(10) Patent No.: US 11,965,304 B2
(45) Date of Patent: Apr. 23, 2024

(54) SELF-SINKING-TYPE DEEP FOUNDATION PIT RETAINING WALL STRUCTURE AND CONSTRUCTION METHOD FOR UNDERGROUND SPACE STRUCTURE

(71) Applicant: Jiangxi Jiye Science And Technology Group Co, Ltd., Jiangxi (CN)

(72) Inventors: Xiangang Liu, Jiangxi (CN); Yonghua Li, Jiangxi (CN); Yunli Xiong, Jiangxi (CN); Liang Peng, Jiangxi (CN)

( * ) Notice: Subject to any disclaimer, the term of this patent is extended or adjusted under 35 U.S.C. 154(b) by 0 days.

(21) Appl. No.: 18/000,627

(22) PCT Filed: Dec. 7, 2020

(86) PCT No.: PCT/CN2020/134189
§ 371 (c)(1),
(2) Date: Dec. 2, 2022

(87) PCT Pub. No.: WO2021/243997
PCT Pub. Date: Dec. 9, 2021

(65) Prior Publication Data

US 2023/0220649 A1 Jul. 13, 2023

(30) Foreign Application Priority Data

Jun. 2, 2020 (CN) ..... 202010509774.2

(51) Int. Cl.
*E02D 23/08* (2006.01)
*E02D 17/04* (2006.01)
*E02D 29/02* (2006.01)
*E02D 29/045* (2006.01)

(52) U.S. Cl.
CPC ..... *E02D 29/02* (2013.01); *E02D 17/04* (2013.01); *E02D 23/08* (2013.01); *E02D 29/045* (2013.01)

(58) Field of Classification Search
CPC ..... E02D 29/02; E02D 17/04; E02D 29/045; E02D 17/02; E02D 23/00; E02D 23/08; E02D 7/24
See application file for complete search history.

(56) References Cited

U.S. PATENT DOCUMENTS 961,788 A * 6/1910 Moran ..... E02D 7/24 37/344
1,907,854 A * 5/1933 Moran ..... E02D 23/08 405/249

(Continued)

FOREIGN PATENT DOCUMENTS

CN 204112351 * 1/2015
CN 204112351 U 1/2015

(Continued)

OTHER PUBLICATIONS

Internatioanl Search Report and Writen Opinion of PCT/CN2020/134189, Mailed Mar. 8, 2021.

*Primary Examiner* — Carib A Oquendo
(74) *Attorney, Agent, or Firm* — Xia Li

(57) ABSTRACT

A self-sinking-type deep foundation pit retaining wall structure, comprising a cylindrical retaining wall body (1); a ground breaking structure (2) is formed at the bottom of the cylindrical retaining wall body (1), and the cylindrical retaining wall body (1) is suitable for achieving downward ground breaking and sinking by means of the cooperation of the ground breaking structure (2) and the gravity of the cylindrical retaining wall body; and a water pipe (20) running through the cylindrical retaining wall body is cast in the cylindrical retaining wall body (1), and the water pipe (20) is provided with a water outlet (80) located at the lower end face of the cylindrical retaining wall body (1) and a water inlet (81) located at the upper end face of the cylindrical retaining wall body (1). The self-sinking-type deep (Continued)

foundation pit retaining wall structure further comprises resistance increasing devices (4) provided on an outer side wall (3) of the cylindrical retaining wall body (1), and the resistance increasing devices (4) are used for cooperating with a foundation (5), so as to adjust upward resistance applied by the foundation (5) to the cylindrical retaining wall body (1). In addition, further provided is a construction method for an underground space.

4 Claims, 4 Drawing Sheets

(56) References Cited

U.S. PATENT DOCUMENTS 1,907,943 A * 5/1933 Fitzpatrick ..... E02D 23/00 405/257
3,851,490 A * 12/1974 Matsushita ..... E02D 7/24 405/248
4,797,031 A * 1/1989 Hagimoto ..... E02D 23/08 405/133
5,002,434 A * 3/1991 Massoudi ..... E02D 29/06 405/133
10,077,539 B1 * 9/2018 Hunt ..... E02D 5/32
2011/0318116 A1 * 12/2011 Cosentino ..... E02D 29/124 405/272

FOREIGN PATENT DOCUMENTS

CN 109403340 A 3/2019
CN 109706952 A 5/2019
CN 110804053 A 2/2020
CN 212506296 U 2/2021
JP H69272240 * 9/1994

* cited by examiner

SELF-SINKING-TYPE DEEP FOUNDATION PIT RETAINING WALL STRUCTURE AND CONSTRUCTION METHOD FOR UNDERGROUND SPACE STRUCTURE

CROSS-REFERENCE TO RELATED APPLICATIONS

This application is a 371 of International Patent Application Number PCT/CN2020/134189, filed on Dec. 7, 2020, which claims the benefit and priority of Chinese Patent Application Number 202010509774.2, filed on Jun. 2, 2020 with China National Intellectual Property Administration, the disclosures of which are incorporated herein by reference in their entireties.

TECHNICAL FIELD

The present disclosure relates to a self-sinking-type deep foundation pit retaining wall structure and a construction method for an underground space structure.

BACKGROUND

Underground buildings are very difficult to construct and too high in cost, especially, the proportion of "foundation pit support" works related to the soft soil foundation is too large, and often the "support cost" is higher than the cost of the main building. In addition, it is complex to construct underground projects, leading to a large number of process steps and a great difficulty in linkage between the process steps, which requires a long construction period and has an excessive impact on the surrounding environment, for example, noise, vibration, exhaust gas, mud, etc. may be generated, and the impact on densely populated areas is greater. In the prior art, when supporting deep foundation pits, retaining walls are mainly formed by means of piling, e.g. Chinese patent document CN108708382A discloses a continuous retaining wall of a deep foundation pit, wherein a continuous engaged part is formed in a way that at least one layer of pile bodies are continuously engaged with each other and are annularly arranged around the foundation pit; a water blocking component is further included, wherein the water blocking component is longitudinally inserted into the engaged position of at least two adjacently arranged pile bodies and used for preventing underground water from permeating from the outer side of the foundation pit to the inner side of the foundation pit of the continuous engaged part; and the water blocking component is made of channel steel or steel plates. Due to the above structure, the underground water can be effectively prevented from permeating from the engaged position of every two adjacent pile bodies into the foundation pit by the water blocking component, so that the water blocking capability of the continuous retaining wall of the deep foundation pit is improved. Chinese patent document CN209308039U discloses an underground space structure of a deep foundation pit, characterized by comprising: a foundation pit, the foundation pit being in a barrel shape; a plurality of cement soil pile bodies annularly arranged along the inner wall of the foundation pit and mutually engaged to each other to form a closed retaining wall; and a plurality of internal support ring beams, fixedly disposed annularly along the inner wall of the retaining wall, which supports the retaining wall from the interior of the foundation pit towards the soil, wherein the spacing of the inner support ring beams decreases gradually from the top to the bottom of the foundation pit. The above two types of foundation pit retaining walls are the two main forms of retaining walls currently available in the prior art, both of which are constructed by means of piling.

Although the pile bodies of the above two types of retaining walls can be hammered to a designed depth according to the construction requirements, the piling construction itself will lead to disadvantages such as more construction processes, large construction noise, longer construction period and greater pollution to the surrounding environment.

In addition, the inconsistent soil conditions at the construction site, such as, the varying water content of the soil at different depths, lead to that the deep foundation pit retaining wall structure bear different frictional resistance when sinking to different depths, thus affecting the speed of sinking, for example, the speed of sinking is too high at a certain depth, which in turn affects the quality of the project.

SUMMARY OF THE INVENTION

For this purpose, the technical problem to be solved by the present disclosure is how to provide a self-sinking-type deep foundation pit retaining wall structure having fewer construction processes, smaller construction noise generated, and a shorter construction period, causing less pollution to the surrounding environment, and allowing a sinking speed to be adjusted according to soil conditions, and a construction method for an underground space.

The present disclosure provides a self-sinking-type deep foundation pit retaining wall structure, including: a cylindrical retaining wall body, wherein the cylindrical retaining wall body includes a first cylinder body and a second cylinder body which are cast together vertically; a ground breaking structure is formed at a bottom of the first cylinder body, the ground breaking structure is a cutting edge structure which has a bevelled edge on the inner side and a cross section being greater on an upper side and smaller on a lower side, the ground breaking structure has a protruding structure protruding outwards with respect to an outer side wall of the cylindrical retaining wall body, the protruding structure has a circumferential diameter greater than that of other parts of the cylindrical retaining wall body, and an outer side face of the protruding structure is vertically disposed or formed; the cylindrical retaining wall body is adapted to achieve downward breaking of the ground and sinking by means of cooperation of the ground breaking structure with a gravity of the cylindrical retaining wall body itself; a longitudinal water pipe running through the cylindrical retaining wall body is vertically cast inside the cylindrical retaining wall body, with a water outlet located on the bevelled edge of the ground breaking structure and a water inlet communicated with the water outlet and located on an upper end face of the cylindrical retaining wall body, a water outlet direction of the water outlet is vertically downward or downward along the bevelled edge; the self-sinking-type deep foundation pit retaining wall structure further comprises a plurality of resistance increasing devices, distributed symmetrically in a circumferential direction, disposed on the outer side wall of the cylindrical retaining wall body, the resistance increasing device is adapted to cooperate with a foundation to adjust upward resistance by the foundation to the cylindrical retaining wall body; the resistance increasing device including a mounting structure disposed on the outer side wall of the cylindrical retaining wall body, a resistance increasing component, and an adjusting mechanism respectively connected to the mounting structure and the resistance increasing component, for adjusting a relative position of the resistance increasing component and the mounting structure, so as to adjust the upward resistance applied by the foundation, through the resistance increasing component, to the cylindrical retaining wall body; the position of the resistance increasing component in a vertical direction is lower than that of the mounting structure, or the resistance increasing component is disposed at the same level as the mounting structure; and the self-sinking-type deep foundation pit retaining wall structure further comprises a lateral water pipe cast in the cylindrical retaining wall body and communicated with the outside at the outer side wall of the cylindrical retaining wall body, the lateral water pipe is communicated with the longitudinal water pipe.

In the above-mentioned self-sinking-type deep foundation pit retaining wall structure, wherein a grouting pipe cast in the cylindrical retaining wall body and communicating the upper end face with an outer side wall of the cylindrical retaining wall body is further included.

In the above-mentioned self-sinking-type deep foundation pit retaining wall structure, wherein the grouting pipe is a crossed grouting pipe, wherein the crossed grouting pipe has a transverse pipe portion transversely penetrating through an inner side wall and the outer side wall of the cylindrical retaining wall body, and a vertical pipe portion vertically extending inside the cylindrical retaining wall body.

In the above-mentioned self-sinking-type deep foundation pit retaining wall structure, wherein the adjusting mechanism is an oil cylinder mechanism or a threaded screwing mechanism, one end of the oil cylinder mechanism or the threaded screwing mechanism being detachably connected to the mounting structure, and the other end of the oil cylinder mechanism or the threaded screwing mechanism being connected to the resistance increasing component.

In the above-mentioned self-sinking-type deep foundation pit retaining wall structure, wherein a reference marker is disposed on an outer side face of the cylindrical retaining wall body for detecting a sinking speed of the cylindrical retaining wall body.

In the above-mentioned self-sinking-type deep foundation pit retaining wall structure, wherein the resistance increasing component is a jacking plate.

The present disclosure further discloses a construction method for an underground space, including the following steps: a. performing shallow foundation treatment; and b. mounting a first mould body; wherein the method further comprises: c. mounting reinforcing steel bars and a first longitudinal water pipe in the first mould body, and pouring concrete in the first mould body to cast a first cylinder body; disposing or forming a ground breaking structure at a bottom of the first cylinder body; wherein the ground breaking structure is a cutting edge structure which has a bevelled edge on an inner side and a cross section being greater on an upper side and smaller on a lower side, the ground breaking structure has a protruding structure protruding outwards with respect to an outer side wall of the cylindrical retaining wall body, the circumferential diameter of the protruding structure is greater than that of other parts of the cylindrical retaining wall body, and an outer side face of the protruding structure is vertically disposed or formed; and disposing a plurality of resistance increasing devices distributed symmetrically in a circumferential direction on an outer side wall of the first cylinder body, the resistance increasing device includes a mounting structure disposed on the outer side wall of the cylindrical retaining wall body, a resistance increasing component, and an adjusting mechanism respectively connected to the mounting structure and the resistance increasing component, for adjusting the relative position of the resistance increasing component and the mounting structure, so as to adjust the upward resistance applied by the foundation, through the resistance increasing component, to the cylindrical retaining wall body; the position of the resistance increasing component in a vertical direction is lower than that of the mounting structure, or the resistance increasing component is disposed at the same level as the mounting structure; the first longitudinal water pipe has a first water outlet located on the bevelled edge of the ground breaking structure and a first water inlet communicated with the first water outlet and located on an upper end face of the first cylinder body, and a water outlet direction of the first water outlet is vertically downward or downward along the bevelled edge; the resistance increasing device is adapted to cooperate with the foundation to adjust the upward resistance by the foundation to the cylindrical retaining wall body; d. excavating and conveying soil outwardly from the inside of the first cylinder body and along an inner side wall of the first cylinder body, so as to cause the first cylinder body to achieve downward breaking of the ground by means of cooperation of the ground breaking structure with a gravity of the first cylinder body; e. detecting a sinking speed of the first cylinder body, and if the current sinking speed of the first cylinder body is lower than a predetermined sinking speed, performing high-pressure water injection into the first cylinder body through the first water inlet of the first longitudinal water pipe, so as to cause a high-pressure water flow ejected out of the first water outlet to scour the soil located at a lower end of the first cylinder body into the first cylinder body, thereby promoting sinking of the first cylinder body under an action of the gravity thereof if the current sinking speed of the first cylinder body is greater than the predetermined sinking speed, adjusting the resistance increasing device to increase the upward resistance by the foundation to the first cylinder body so as to lower the sinking speed of the first cylinder body; f. after the first cylinder body sinks to a predetermined depth, mounting a second mould body above the first cylinder body, mounting reinforcing steel bars and a second longitudinal water pipe in the second mould body, communicating the second longitudinal water pipe with the first longitudinal water pipe, and pouring concrete in the second mould body to cast a second cylinder body, wherein the second longitudinal water pipe has a second water inlet located on an upper end face of the second cylinder body; and g. excavating and conveying soil outwardly from the inside of the first cylinder body and the second cylinder body and along inner side walls of the first cylinder body and the second cylinder body, and performing high-pressure water injection inwardly through the second water inlet of the second longitudinal water pipe, so as to cause a high-pressure water flow ejected out of the first water outlet to scour the soil located at the lower end of the first cylinder body into the first cylinder body, thereby promoting sinking of the first cylinder body and the second cylinder body to the predetermined depth under the action of the gravity thereof wherein in the above-mentioned step c and/or step e, a lateral water pipes is further mounted, wherein the lateral water pipe is communicated with the outside at the outer side wall of the cylindrical retaining wall body and is communicated with the second water inlet.

In the above-mentioned construction method for an underground space, wherein casting a base plate at a foundation base when sinking to the predetermined depth, and pressing a concrete slurry into the foundation base through the first longitudinal water pipe and the second longitudinal water pipe according to the requirements of the strength or buoyancy resistance of the base plate, or additionally disposing pile bodies or anchor rods on the base plate to reinforce the buoyancy resistance of the foundation base is further included.

In the above-mentioned construction method for an underground space, wherein a step of casting a grouting pipe in the cylindrical retaining wall body in the above step c, to communicate the upper end face and an outer side face of the cylindrical retaining wall body.

The above-mentioned technical solution of the present disclosure has the following beneficial effects.

A self-sinking-type deep foundation pit retaining wall structure disclosed in the embodiment of the present disclosure includes a cylindrical retaining wall body, wherein a ground breaking structure is formed at the bottom of the cylindrical retaining wall body, the ground breaking structure is a cutting edge structure which has a bevelled edge on the inner side and a cross section being greater on an upper side and smaller on a lower side, which is able to facilitate the cutting of soil, achieve fast sinking and speed up the construction progress.

The ground breaking structure has a protruding structure protruding outwards with respect to an outer side wall of the cylindrical retaining wall body, the circumferential diameter of the protruding structure is greater than the circumferential diameter of other parts of the cylindrical retaining wall body, this design can reduce the contact area of the soil with the outer side wall of the cylindrical retaining wall body, so as to reduce the friction resistance, which is able to achieve fast sinking, so as to speed up the construction progress.

An outer side face of the protruding structure is vertically disposed or formed, which reduces the end resistance by the soil to the outer side wall of the cylindrical retaining wall body, due to cooperation of vertical disposing with the cutting edge structure, which is able to achieve fast sinking, so as to speed up the construction progress.

A water pipe is vertically cast inside the cylindrical retaining wall body, the water pipe has a water outlet located on the bevelled edge of the ground breaking structure and a water inlet located on an upper end face of the cylindrical retaining wall body, wherein the water outlet direction of the water outlet is vertically downward or downward along the bevelled edge; due to the above design, on the one hand, soil can be softened by injecting water through the water pipe to the soil located on the lower end face of the cylindrical retaining wall body or at the position of the cutting edge structure, thus achieving the purpose of reducing the end resistance of the cylindrical retaining wall body in order to facilitate the sinking of the cylindrical retaining wall body, besides, the soil at the position of the cutting edge structure can also be scoured by introducing a high pressure water flow, which facilitates fast removing of the soil and enables the cylindrical retaining wall body to sink by gravity, thus speeding up the construction progress.

A plurality of resistance increasing devices, symmetrically distributed in a circumferential direction, disposed on the outer side wall of the cylindrical retaining wall body are used for adjusting the upward resistance by the foundation to the cylindrical retaining wall body, which is more conducive to adjusting the sinking speed and/or the verticality of the cylindrical retaining wall body. The resistance increasing devices are disposed, which ensures the engineering quality and also achieves the control over the sinking speed of the self-sinking-type deep foundation pit retaining wall structure according to different soil conditions, and makes the self-sinking-type deep foundation pit retaining wall structure of the present disclosure be constructed under various comprehensive soil conditions, thus making the present disclosure high applicable in construction environment.

The cylindrical retaining wall body includes a first cylinder body and a second cylinder body which are cast together vertically; due to this design, construction can be performed according to the design depth, which saves materials and reduces the construction cost.

The self-sinking-type deep foundation pit retaining wall structure further includes: lateral water pipes cast in the cylindrical retaining wall body and communicated with the outside at the outer side wall of the cylindrical retaining wall body, the lateral water pipe being communicated with the longitudinal water pipe. By injecting water into the lateral water pipe, water flow flows onto soil on the outer side wall of the cylindrical retaining wall body to soften the soil, thus reducing the abrasive resistance of the soil to the cylindrical retaining wall body, which in turn facilitates the sinking of the cylindrical retaining wall body and speeds up the construction progress.

In addition, since the present disclosure does not use a high-power piling apparatus to perform piling construction of a foundation pit, noise generated is reduced, and pollution to the surrounding environment is reduced.

In conclusion, the construction procedures of the self-sinking-type deep foundation pit retaining wall structure of the present disclosure are few, which is conductive to speeding up the construction progress, saves the construction cost, reduces the construction noise and pollution to the surrounding environment, and also improves the applicability to the construction environment.

The cylindrical retaining ball body further includes a grouting pipe cast inside the cylindrical retaining wall body, communicating the upper end face with an outer side face of the cylindrical retaining wall body; the grouting pipe is additionally disposed, which can introduce the concrete slurry to the soil at a foundation base and the outer side wall after the cylindrical retaining wall body sinks to a final predetermined depth, in order to achieve a water stopping and reinforcing effect.

In an embodiment of the present disclosure, the adjusting mechanism is an oil cylinder mechanism or a threaded screwing mechanism, one end of the oil cylinder mechanism or the threaded screwing mechanism being detachably connected to the mounting structure, and the other end of the oil cylinder mechanism or the threaded screwing mechanism being connected to the resistance increasing component. Due to a mode of a detachable connection, after the cylindrical retaining wall body sinks to a certain position and the resistance increasing device is not required any more, the resistance increasing device is dismantled, which is conductive to subsequent reuse, thus reducing the construction cost.

The position of the resistance increasing component in a vertical direction is lower than the position of the mounting structure, enabling the mounting structure to have a downward supporting effect on the resistance increasing component and achieving the jacking effect on the cylindrical retaining wall body.

A reference marker is disposed on an outer side face of the cylindrical retaining wall body, the reference marker can be used as a reference object by construction workers or a relevant detection device, thus making it easier to determine or detect the sinking speed.

The resistance increasing component is a jacking plate, which can form a large soil contact area on a foundation with a high water content, thereby ensuring a sufficiently large resistance.

The cylindrical retaining ball body further includes a cut-through grouting pipe cast in the cylindrical retaining wall body and located between the upper end face and an outer end face of the cylindrical retaining wall body; the grouting pipe is additionally disposed, which can introduce a concrete slurry to the soil at a foundation base and the outer side wall after the cylindrical retaining wall body sinks to a final predetermined depth, in order to achieve a water stopping and reinforcing effect.

The above construction method for an underground space disclosed in the embodiment of the present disclosure not only achieves the above-mentioned advantages of the above-mentioned retaining wall structure, but also further has the following advantages, that is, soil is excavated and conveyed outwardly along an inner side wall of the first cylinder body and/or the second cylinder body, which can ensure smooth sinking of the cylindrical retaining wall body, and can also reduce the construction work and speed up the construction progress.

BRIEF DESCRIPTION OF THE DRAWINGS

To describe the technical solutions in specific embodiments of the present disclosure or the prior art more clearly, the accompanying drawings required for describing the specific embodiments or the prior art will be briefly introduced. Apparently, the accompanying drawings in the following description show only some embodiments of the present disclosure, and a person of ordinary skill in the art may still acquire other accompanying drawings from the accompanying drawings without creative efforts.

LIST OF REFERENCE NUMERALS

Cylindrical retaining wall body; 2—Ground breaking structure; 3—Outer side wall; 4—Resistance increasing device; 5—Foundation; 6—Mounting structure; 7—Resistance increasing component; 8—Adjusting mechanism; 11—First cylinder body; 12—Second cylinder body; 20—Longitudinal water pipe; 30—Lateral water pipe, 80—water outlet; 81—Water inlet; 30—Lateral water pipe, 101—protruding structure.

DETAILED DESCRIPTION OF EMBODIMENTS

The technical solutions of the present disclosure will be clearly and completely described below with reference to the accompanying drawings. Apparently, the described embodiments are merely some rather than all of the embodiments of the present disclosure. All other embodiments obtained by a person of ordinary skill in the art based on the embodiments in the present disclosure without creative efforts shall fall within the protection scope of the present disclosure.

Furthermore, the technical features involved in different implementation modes of the present disclosure described below can be combined with each other as long as they do not conflict with each other.

Embodiment 1

Figure 1:
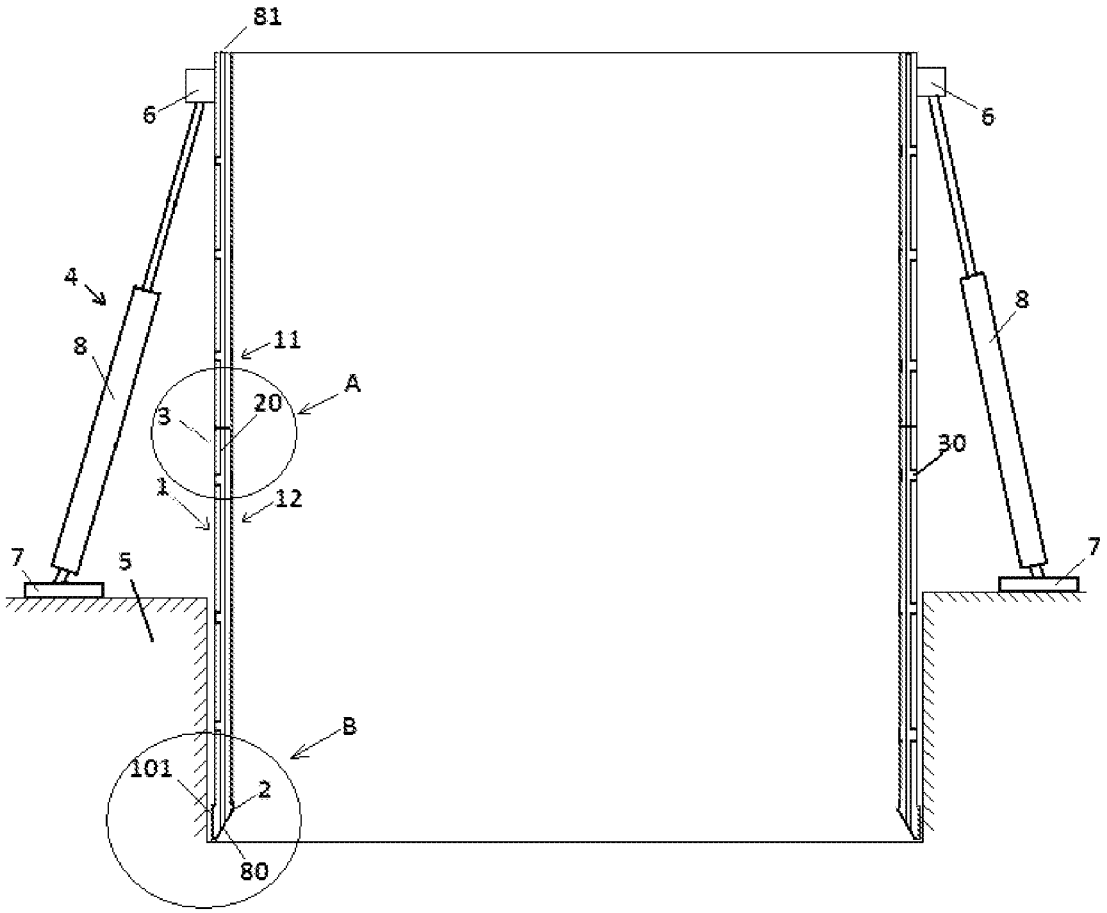
FIG. 1 is a schematic view of one embodiment of a self-sinking-type deep foundation pit retaining wall structure of the present disclosure.
Figure 2:
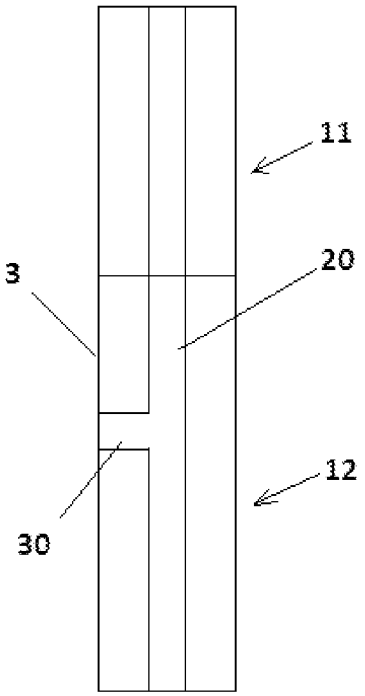
FIG. 2 is an enlarged view of position A of FIG. 1.
Figure 3:
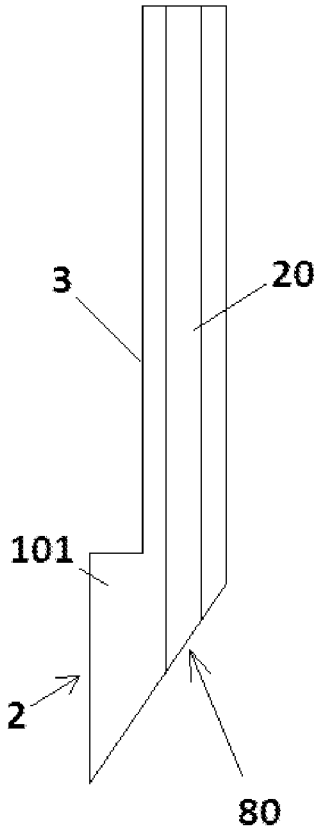
FIG. 3 is an enlarged view of position B of FIG. 1.
Figure 4:
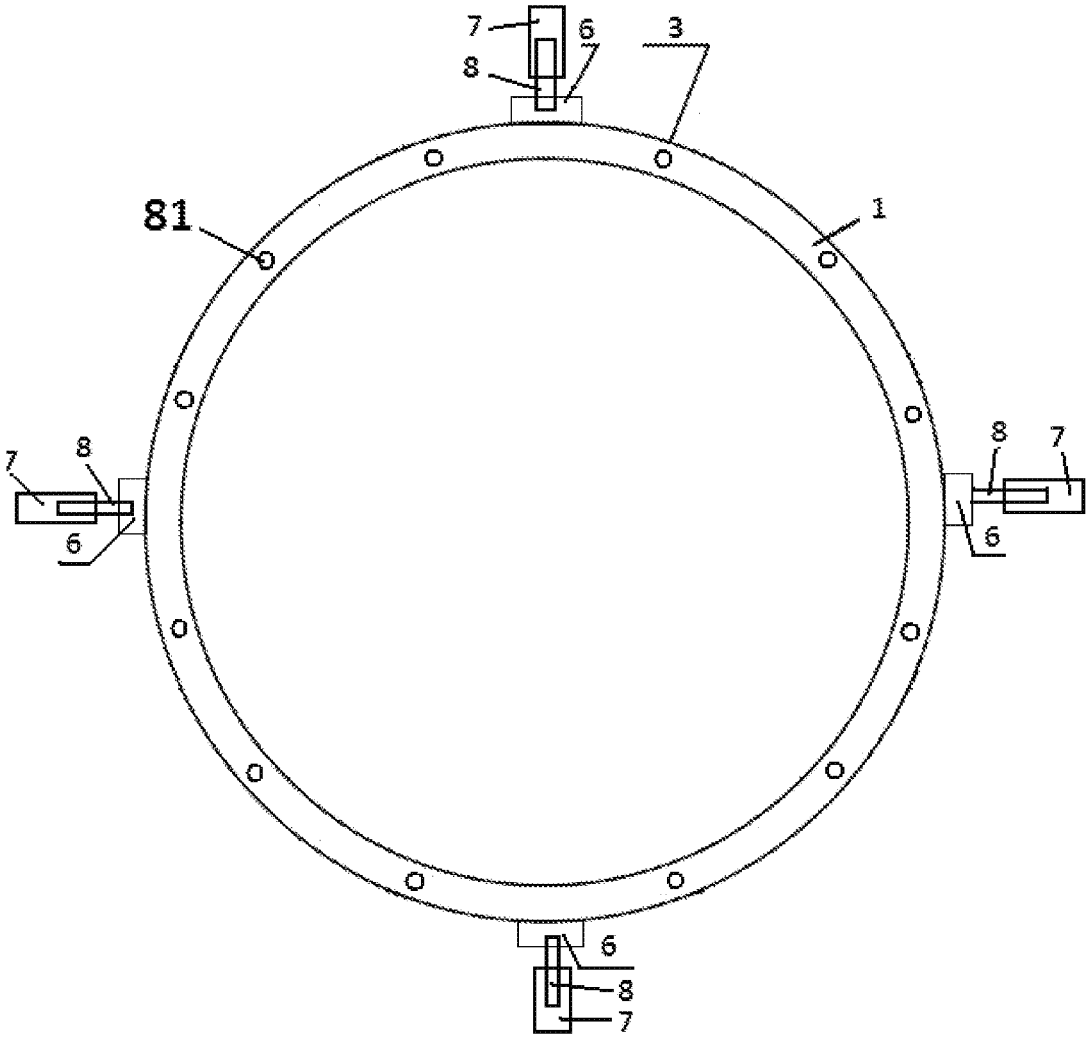
FIG. 4 is a top view of the self-sinking-type deep foundation pit retaining wall structure of FIG. 1.

As shown in FIG. 1 to FIG. 4, the present embodiment provides a self-sinking-type deep foundation pit retaining wall structure, including a cylindrical retaining wall body 1, wherein the cylindrical retaining wall body includes a first cylinder body 11 and a second cylinder body 12 which are cast together vertically; a ground breaking structure 2 is formed at the bottom of the cylindrical retaining wall body 1, the ground breaking structure 2 is a cutting edge structure which has a bevelled edge on the inner side and a cross section being greater on an upper side and smaller on a lower side, wherein the ground breaking structure 2 has a protruding structure 101 protruding outwards with respect to an outer side wall of the cylindrical retaining wall body, the circumferential diameter of the protruding structure is greater than the circumferential diameter of other parts of the cylindrical retaining wall body, and an outer side face of the protruding structure is vertically disposed or formed; the cylindrical retaining wall body is 1 adapted to achieve downward breaking of the ground and sinking by means of cooperation of the ground breaking structure 2 with the gravity of the cylindrical retaining wall body itself; a longitudinal water pipe 20 running through the cylindrical retaining wall body 1 is vertically cast inside the cylindrical retaining wall body 1, the longitudinal water pipe 20 has a water outlet 80 located on the bevelled edge of the ground breaking structure and a water inlet 81 located on an upper end face of the cylindrical retaining wall body 1, wherein the water outlet direction of the water outlet 80 is vertically downward, or as an alternative embodiment, the water outlet 80 may also be downward along the bevelled edge (not shown herein); the self-sinking-type deep foundation pit retaining wall structure of the present embodiment further includes: a plurality of resistance increasing devices 4, distributed symmetrically in a circumferential direction, disposed on the outer side wall 3 of the cylindrical retaining wall body 1, the resistance increasing device 4 is adapted to cooperate with a foundation 5 to adjust upward resistance by the foundation 5 to the cylindrical retaining wall body 1; the resistance increasing device 4 including a mounting structure 6 disposed on the outer side wall 3 of the cylindrical retaining wall body 1, a resistance increasing component 7, and an adjusting mechanism 8 respectively connected to the mounting structure 6 and the resistance increasing component 7, for adjusting the relative position of the resistance increasing component 7 and the mounting structure 6, so as to adjust the upward resistance applied by the foundation 5, through the resistance increasing component 7, to the cylindrical retaining wall body 1; wherein the position of the resistance increasing component 7 in a vertical direction is lower than the position of the mounting structure 6, however, as another alternative embodiment, the resistance increasing component can also be disposed at the same level as the mounting structure; the self-sinking-type deep foundation pit retaining wall structure further includes: a lateral water pipes 30 cast inside the cylindrical retaining wall body 1 and communicated with the outside at the outer side wall 3 of the cylindrical retaining wall body 1, the lateral water pipe 30 is communicated with the longitudinal water pipe 20.

As a preferred embodiment, a grouting pipe is further cast in the cylindrical retaining wall body and communicates the upper end face with an outer side face of the cylindrical retaining wall body.

The grouting pipe is preferably a crossed grouting pipe, wherein the crossed grouting pipe has a transverse pipe portion transversely penetrating through an inner side face and the outer side wall of the cylindrical retaining wall body, and a vertical pipe portion vertically extending inside the cylindrical retaining wall body.

The adjusting mechanism may be an oil cylinder mechanism or a threaded screwing mechanism, one end of the oil cylinder mechanism or the threaded screwing mechanism being detachably connected to the mounting structure, and the other end of the oil cylinder mechanism or the threaded screwing mechanism being connected to the resistance increasing component.

A reference marker (not shown herein) is disposed on an outer side face of the cylindrical retaining wall body for detecting a sinking speed of the cylindrical retaining wall body.

The resistance increasing component is preferably a jacking plate.

Embodiment 2

The present embodiment discloses a construction method for an underground space, including the following steps:

a. performing shallow foundation treatment;

b. mounting a first mould body;

wherein the method further includes:

c. mounting reinforcing steel bars and a first longitudinal water pipe in the first mould body, and pouring concrete in the first mould body to cast a first cylinder body; disposing or forming a ground breaking structure at a bottom of the first cylinder body; wherein, the ground breaking structure is a cutting edge structure which has a bevelled edge on the inner side and a cross section being greater on the upper side and smaller on the lower side, wherein the ground breaking structure has a protruding structure protruding outwards with respect to an outer side wall of the first cylinder body, the circumferential diameter of the protruding structure being greater than the circumferential diameter of other parts of the first cylinder body, and an outer side face of the protruding structure is vertically disposed or formed; and disposing a plurality of resistance increasing devices distributed symmetrically in a circumferential direction on the outer side wall of the first cylinder body, wherein the resistance increasing device includes a mounting structure disposed on the outer side wall of the first cylinder body, a resistance increasing component, and an adjusting mechanism respectively connected to the mounting structure and the resistance increasing component, for adjusting the relative position of the resistance increasing component and the mounting structure, so as to adjust the upward resistance applied by the foundation, through the resistance increasing component, to the first cylinder body; wherein the position of the resistance increasing component in a vertical direction is lower than the position of the mounting structure, or the resistance increasing component is disposed at the same level as the mounting structure; and the first longitudinal water pipe has a first water outlet located on the bevelled edge of the ground breaking structure and a first water inlet located on an upper end face of the first cylinder body, and the water outlet direction of the first water outlet is vertically downward or downward along the bevelled edge; the resistance increasing device is adapted to cooperate with the foundation to adjust the upward resistance by the foundation to the first cylinder body;

d. excavating and conveying soil outwardly from the inside of the first cylinder body and along an inner side wall of the first cylinder body, so as to cause the first cylinder body to achieve downward breaking of the ground by means of cooperation of the ground breaking structure with the gravity of the first cylinder body;

e. detecting a sinking speed of the first cylinder body, and if the current sinking speed of the first cylinder body is lower than a predetermined sinking speed, performing high-pressure water injection into the first cylinder body through the first water inlet of the first longitudinal water pipe, so as to cause a high-pressure water flow ejected out of the first water outlet to scour soil located at a lower end of the first cylinder body into the first cylinder body, thereby promoting sinking of the first cylinder body under an action of the gravity thereof; if the current sinking speed of the first cylinder body is greater than the predetermined sinking speed, adjusting the resistance increasing device to increase the upward resistance by the foundation to the first cylinder body, so as to lower the sinking speed of the first cylinder body;

f. after the first cylinder body sinks to a predetermined depth, mounting a second mould body above the first cylinder body, mounting reinforcing steel bars and a second longitudinal water pipe in the second mould body, communicating the second longitudinal water pipe with the first longitudinal water pipe, and pouring concrete in the second mould body to cast a second cylinder body, wherein the second longitudinal water pipe has a second water inlet located on an upper end face of the second cylinder body; and g. excavating and conveying soil outwardly from the inside of the first cylinder body and the second cylinder body and along inner side walls of the first cylinder body and the second cylinder body, and performing high-pressure water injection inwardly through the second water inlet of the second longitudinal water pipe, so as to cause a high-pressure water flow ejected out of the first water outlet to scour the soil located at the lower end of the first cylinder body into the first cylinder body, thereby promoting sinking of the first cylinder body and the second cylinder body to the predetermined depth under the action of the gravity thereof; wherein in the above-mentioned step c and/or step e, a lateral water pipes is further mounted, wherein the lateral water pipe is communicated with the outside at the outer side wall of the first cylinder body and is communicated with the second water inlet.

As a preferred embodiment, the method further comprises casting a base plate at a foundation base when sinking to the predetermined depth, and pressing a concrete slurry into the foundation base through the first longitudinal water pipe and the second longitudinal water pipe according to the requirements of the strength or buoyancy resistance of the base plate, or additionally disposing pile bodies or anchor rods on the base plate to reinforce the buoyancy resistance of the foundation base.

The method further comprises a step of casting a grouting pipe in the first cylinder body in the above step c, to communicate the upper end face and an outer side face of the first cylinder body.

Obviously, the above-mentioned embodiments are only examples for clearly illustrating the present disclosure, rather than limiting the implementation modes. For those of ordinary skill in the art, changes or modifications in other different forms can also be made on the basis of the above description. It is not needed and it is impossible to list all implementation modes here. The obvious changes or modifications derived therefrom are still within the scope of protection of the present disclosure.

The invention claimed is:

1. A self-sinking-type deep foundation pit retaining wall structure, comprising:

a cylindrical retaining wall body, wherein the cylindrical retaining wall body comprises a first cylinder body and a second cylinder body which are cast together vertically; a ground breaking structure is formed at a bottom of the first cylinder body, the ground breaking structure is a cutting edge structure which has a bevelled edge on an inner side and a cross section being greater on an upper side and smaller on a lower side; the ground breaking structure has a protruding structure protruding outwards with respect to an outer side wall of the cylindrical retaining wall body, the protruding structure has a circumferential diameter greater than that of other parts of the cylindrical retaining wall body, and an outer side face of the protruding structure is vertically disposed or formed; the cylindrical retaining wall body is adapted to achieve downward breaking of the ground and sinking by means of cooperation of the ground breaking structure with a gravity of the cylindrical retaining wall body itself; a longitudinal water pipe running through the cylindrical retaining wall body is vertically cast inside the cylindrical retaining wall body, with a water outlet located on the bevelled edge of the ground breaking structure and a water inlet communicated with the first water outlet and located on an upper end face of the cylindrical retaining wall body, a water outlet direction of the water outlet is vertically downward or downward along the bevelled edge;

the self-sinking-type deep foundation pit retaining wall structure further comprises: a plurality of resistance increasing devices, distributed symmetrically in a circumferential direction, disposed on the outer side wall of the cylindrical retaining wall body, the resistance increasing device is adapted to cooperate with a foundation to adjust upward resistance by the foundation to the cylindrical retaining wall body; the resistance increasing device comprising a mounting structure disposed on the outer side wall of the cylindrical retaining wall body, a resistance increasing component, and an adjusting mechanism respectively connected to the mounting structure and the resistance increasing component, for adjusting a relative position of the resistance increasing component and the mounting structure, so as to adjust the upward resistance applied by the foundation, through the resistance increasing component, to the cylindrical retaining wall body; the position of the resistance increasing component in a vertical direction is lower than that of the mounting structure, or the resistance increasing component is disposed at the same level as the mounting structure; and the self-sinking-type deep foundation pit retaining wall structure further comprises: a lateral water pipe cast in the cylindrical retaining wall body and communicated with the outside at the outer side wall of the cylindrical retaining wall body, the lateral water pipe is communicated with the longitudinal water pipe;

a grouting pipe cast inside the cylindrical retaining wall body and communicating the upper end face with an outer side wall of the cylindrical retaining wall body;

wherein, the grouting pipe is a crossed grouting pipe, wherein the crossed grouting pipe has a transverse pipe portion transversely penetrating through an inner side wall and the outer side wall of the cylindrical retaining wall body, and a vertical pipe portion vertically extending inside the cylindrical retaining wall body.

2. The self-sinking-type deep foundation pit retaining wall structure according to claim 1, wherein the adjusting mechanism is an oil cylinder mechanism or a threaded screwing mechanism, one end of the oil cylinder mechanism or the threaded screwing mechanism is detachably connected to the mounting structure, and the other end of the oil cylinder mechanism or the threaded screwing mechanism is connected to the resistance increasing component.

3. The self-sinking-type deep foundation pit retaining wall structure according to claim 2, wherein a reference marker is disposed on an outer side face of the cylindrical retaining wall body for detecting a sinking speed of the cylindrical retaining wall body.

4. The self-sinking-type deep foundation pit retaining wall structure according to claim 3, wherein the resistance increasing component is a jacking plate.

* * * * *